US006010434A

United States Patent [19]

Hodges

[11] Patent Number: 6,010,434

[45] Date of Patent: Jan. 4, 2000

[54] KNEE REHABILITATION EXERCISE APPARATUS

[76] Inventor: Samuel G. Hodges, 4924 Cobbs Dr., 4G, Waco, Tex. 76710

[21] Appl. No.: 09/263,478

[22] Filed: Mar. 8, 1999

[51] Int. Cl.[7] ..... A63B 22/06

[52] U.S. Cl. ..... 482/57; 482/70; 482/129; 482/130; 482/138

[58] Field of Search ..... 482/57, 70, 129, 482/130, 138

[56] References Cited

U.S. PATENT DOCUMENTS 4,709,918 12/1987 Grinblat ..... 482/70
5,487,714 1/1996 Ferrari .
5,499,958 3/1996 Hess .
5,607,381 3/1997 Endelman .
5,626,546 5/1997 Little .
5,669,863 9/1997 Ho .

*Primary Examiner*—John Mulcahy
*Attorney, Agent, or Firm*—Joseph H. McGlynn; Patent & Trademark Services

[57] ABSTRACT

An exercise device for rehabilitating knees comprising a framework, an adjustable seat, exercise pedals and reciprocating shuttles which are mounted on supporting tracks and can be used to perform various exercises.

12 Claims, 5 Drawing Sheets

KNEE REHABILITATION EXERCISE APPARATUS

BACKGROUND OF THE INVENTION

This invention relates, in general, to exercise devices, and, in particular, to an exercise device for rehabilitating the knee.

DESCRIPTION OF THE PRIOR ART

In the prior art various types of exercise devices have been proposed. For example U.S. Pat. No. 5,669,863 to Ho discloses a leg exerciser with a retractable support bar.

U.S. Pat. No. 5,626,546 to Little discloses a wall mount exerciser which allows a person to use exercise bands from a chair.

U.S. Pat. No. 5,607,381 to Endelman discloses an exerciser with a sliding platform which uses springs to provide resistance.

U.S. Pat. No. 5,499,958 to Hess discloses an exerciser with an inclined ramp, foot rests, and spring resistance.

U.S. Pat. No. 5,487,714 to Ferrari discloses a resistance exerciser having an adjustable seat attached thereto.

SUMMARY OF THE INVENTION

The present invention is directed to an exercise device for rehabilitating knees, although it could also be used for other body parts. The device comprises a framework, a movable/adjustable seat, exercise pedals and reciprocating shuttles which are mounted on supporting tracks and which can be used to perform various exercises.

It is an object of the present invention to provide an exercise device for rehabilitating injured knees.

It is an object of the present invention to provide an exercise device for rehabilitating injured knees which can be used to perform a variety of exercises.

It is an object of the present invention to provide an exercise device for rehabilitating injured knees in which all levels of exercises, from beginner to advanced, can be performed on one machine.

These and other objects and advantages of the present invention will be fully apparent from the following descriptions, when taken in connection with the annexed drawings.

DESCRIPTION OF THE PREFERRED EMBODIMENT

Figure 1:
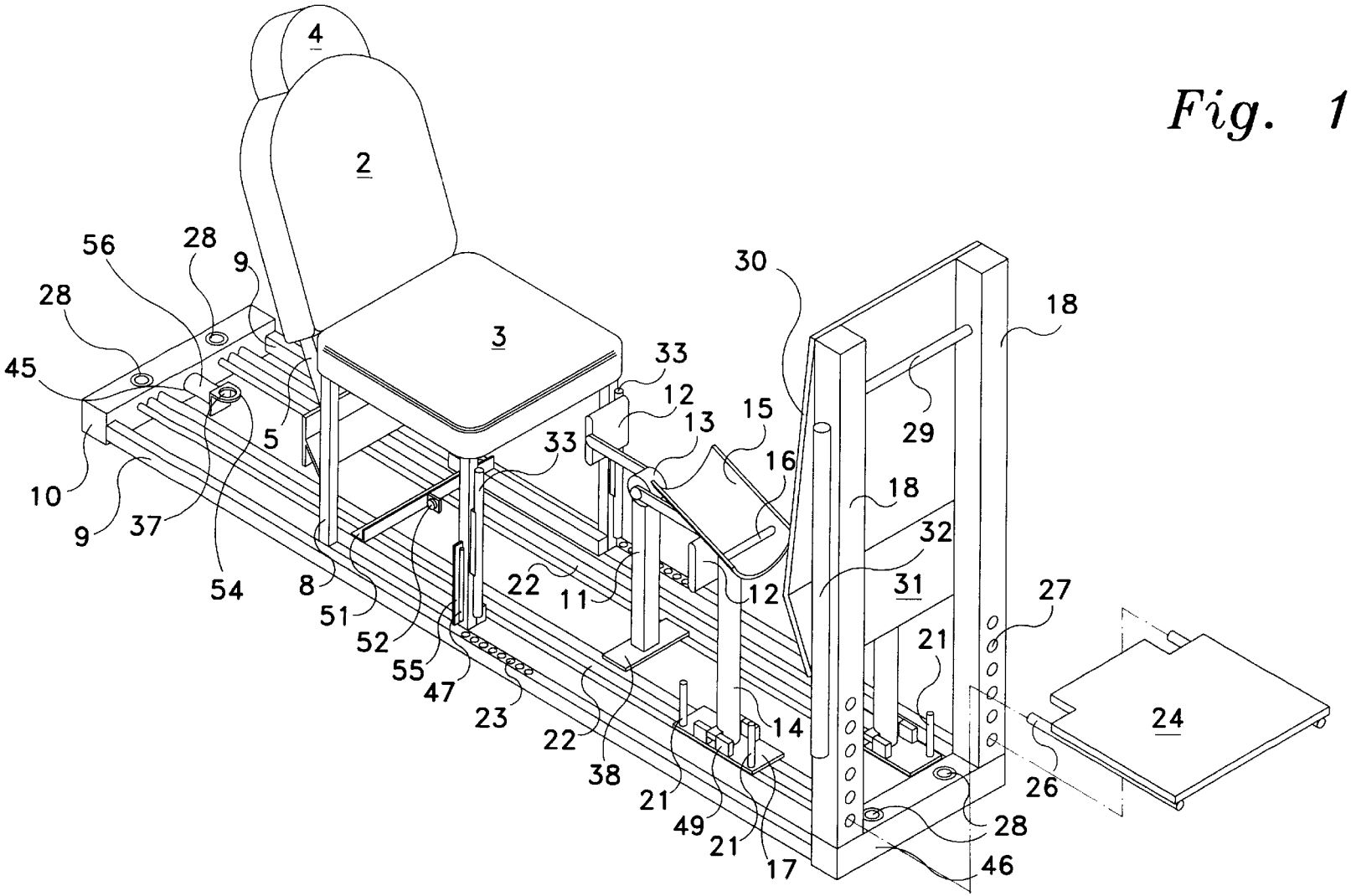
FIG. 1 is a perspective view of the present invention.

Referring now to the drawings in greater detail, FIG. 1 shows the knee rehabilitation apparatus 1 of the present invention. The apparatus comprises a frame having end pieces 10, 46 and side pieces 9 connected to the end pieces.

Figure 8:
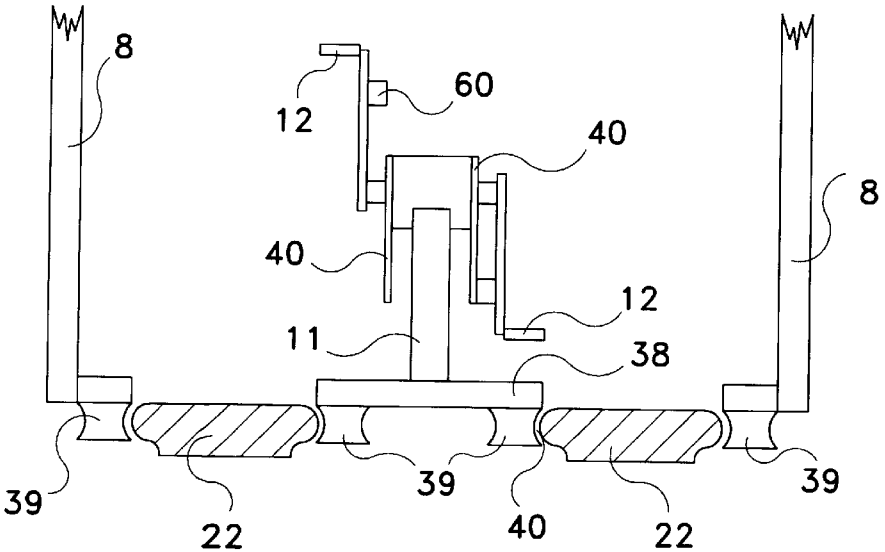
FIG. 8 is a view showing the pedal assembly mounted on their tracks and a front view of the chair mounted on its tracks.

Positioned between the end pieces 10, 46 are tracks 22 (also shown in FIG. 8) which support various attachments such as the pedal assembly 11, 12, 13 and the shuttles 17, 21 21, 49, and, chair 2, 3, 4, and also allows these attachments to move along the tracks. Attached to the tracks 22 is a chair with a seat portion 3, a back rest 2, and a head rest 4. The chair has supporting legs 8 to attach it to the tracks 22 by rollers 39. The front legs of the chair have tension band support bars 33 attached near the top of the front legs 8 in such a manner as to cause a continuous 3/16 inch space from the attachment past the free end of support bars 33, for a purpose to be described below.

Figure 13:
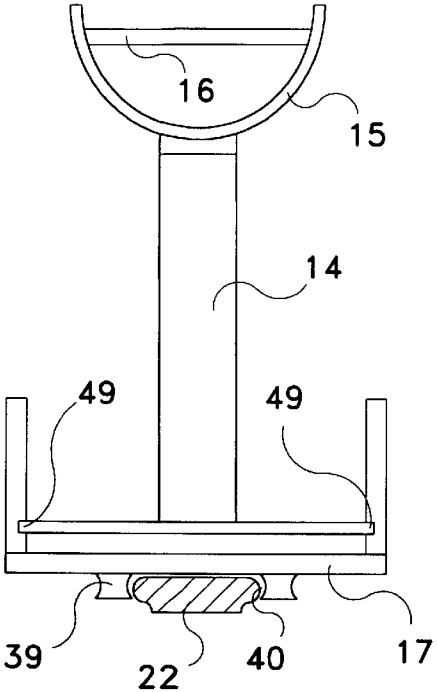
FIG. 13 is a partial view showing one of the shuttle risers mounted on a shuttle assembly, and a partial view showing one of the shuttle assemblies mounted on its tracks.

It should be noted that there are two shuttles mounted on the tracks, however, only one is shown in FIG. 1 for purposes of clarity. Each shuttle assembly comprises a supporting plate 17 (see also FIG. 13) which have supporting blocks 49 and posts 21 attached thereto in any conventional manner. The support blocks support the riser 14, which is shown in FIG. 13. At the top of the riser 14 is a leg or foot rest 15 curved to make it more comfortable for a user to rest his/her leg or foot inside the concave surface of the foot rest 15. Spanning across the curved sides of the foot rest 15 is a rod 16 which will allow the user to pull or push against when doing various exercises. The plate 17 is similar to the plate 38 (see FIG. 13), has rollers 39 attached to the bottom of the plate which engage the V-shape extensions 40 on tracks 22 to allow the plate to reciprocate along the tracks 22.

Figure 14:
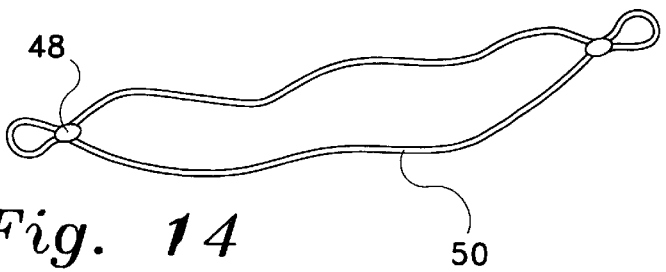
FIG. 14 shows one of the resistance bands used with the present invention.
Figure 17:
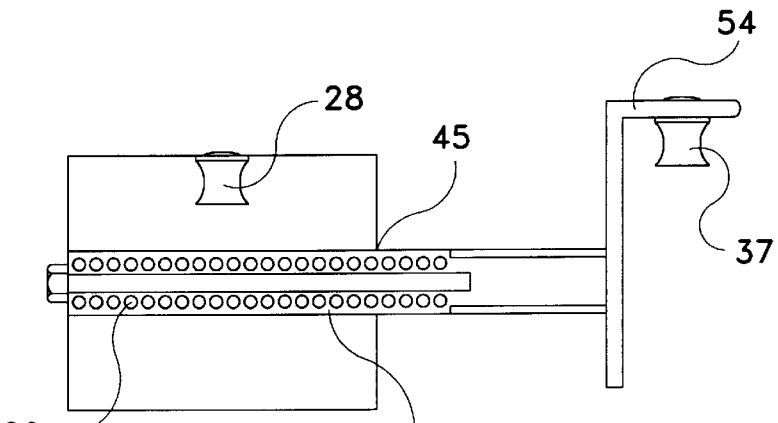
FIG. 17 is a partial view showing the auto-tension system for the cable.
Figure 18:
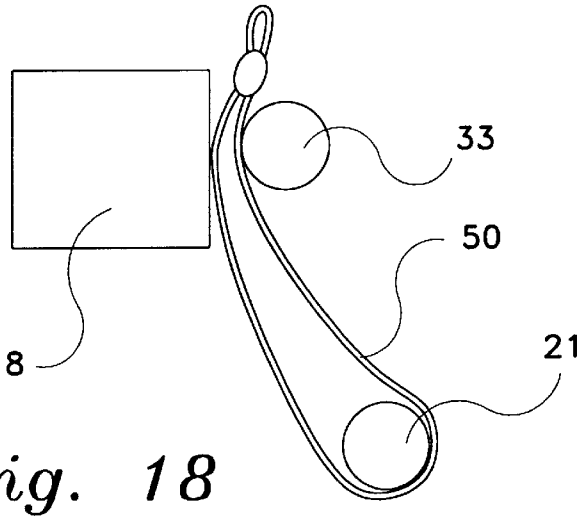
FIG. 18. is a partial view showing one band attached.

Elastic tension bands 50, shown in FIG. 14, can be attached to the bars 33, 32 and posts 21 to provide resistance while a user is performing a variety of exercises. The tension bands can be made from any type of elastic material and can be provided in various resistances so the doctor or physical therapist can prescribe exact tensions from start to finish of the rehabilitation process. In addition, the bands should have an indicia thereon, such as, but not limited to, color coding so a user will know the resistance being used.

At one end of the frameworks is a pair of vertical posts 18 which are attached to the end piece 46 by any conventional means. The posts 18 have a series of apertures 27 positioned thereon, adjacent their lower end. The apertures 27 receive bars 26 which are attached to the adjustable step 24. By placing the bars 26 in the apertures 27, the height of the step can be adjusted so a user can perform step exercises. The bar 29, mounted adjacent the upper end of the posts 18, provide the user with a hand rest for stability while performing step exercises. In addition bars 32 are mounted on each of the posts 18 midway of the length of bar 32, in such a way as to cause a continuous 3/16 inch space between posts 18 and bars 32 from attachment up to the upper free end of bar 32 and down to the lower free end so that the bands 50 can be attached thereto while performing various exercises.

The bands 50 can be attached in various ways, depending on: resistance level, direction of resistance, or whether the apparatus serves only as an anchor point for the band's two knotted ends while the center is looped around a body part, i.e. calf, knee, thigh etc. Attaching the band from left bar 33 to left post 21 will provide forward loading of the left shuttle and rearward loading of the right shuttle. Attaching the band from right bar 33 to right post 21 will provide forward loading of the right shuttle and rearward loading of the left shuttle. Attaching the band from left post 21 to left bar 32 will provide rearward loading of the left shuttle and forward loading of the right shuttle. Attaching the band from right post 21 to right bar 32 will provide forward loading of the left shuttle and rearward loading of the right shuttle . Attaching the band from left bar 33 to left bar 32 and/or from right bar 33 to right bar 32 loads chair 2, 3, 4 in relationship to pressure plates 30 and/or 31. Any anchor position around capturing body parts loads in practically all directions from various anchor point on the apparatus. It should be noted that resistance can be varied using bands of different values, the number of bands, the number of attachment positions, or various combinations of the preceding three. Also attached to the posts 18 are push plates 30, 31 which a user can place their feet against and push while sitting, or lying in the chair. This will allow the user to perform various isometric exercises. The push plate surface 30 is angled with respect to the plate surface 31 which will provide strength to the push plate 30 and will allow the user to place his/her feet in a variety of positions to perform exercises.

Figure 2:
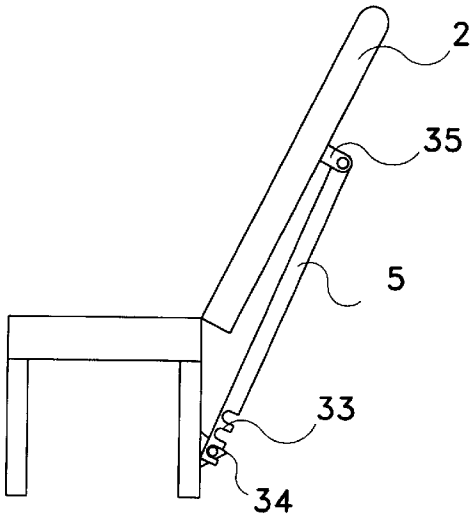
FIGS. 2–4 are side views showing the chair of the present invention in various adjusted positions.
Figure 3:
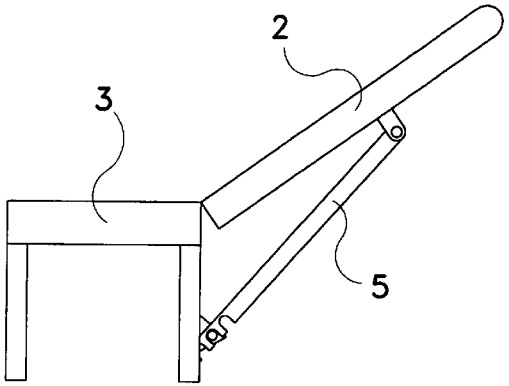
Figure 4:
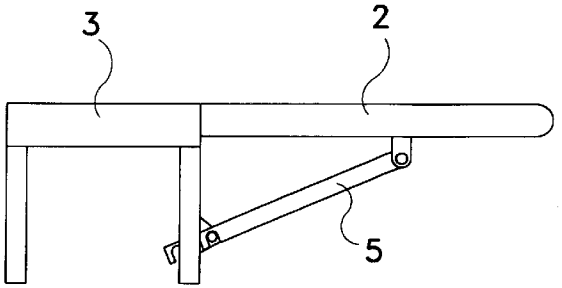

As shown in FIGS. 2–4, the back rest 2 of the chair is adjustable with respect to the seat 3. The back has a rod 5 attached thereto by a bracket 35 at its upper end. The lower end of the rod 5 has a series of slots 43 therein. The rear legs 8 have a plate attached thereto, and the plate has a pin or bar 34, allowing the chair back 2 to be adjusted from a vertical to a horizontal position.

Figure 5:
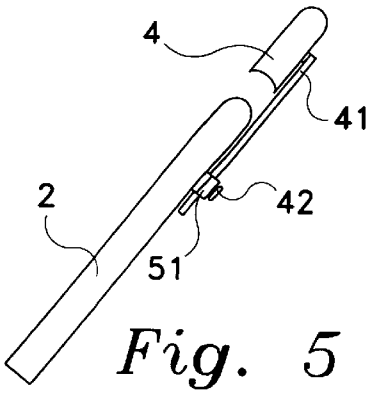
FIG. 5 is a partial view of the chair of the present invention showing the head rest in an adjusted position.
Figure 6:
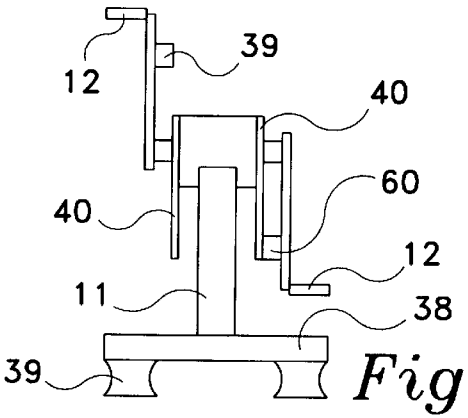
FIGS. 6 and 7 are an end view an a side view, respectfully, showing the pedal assembly of the present invention.
Figure 7:
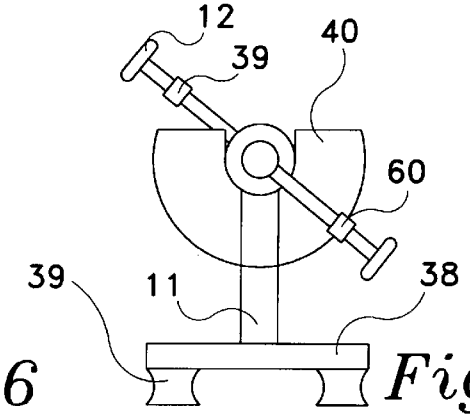
Figure 9:
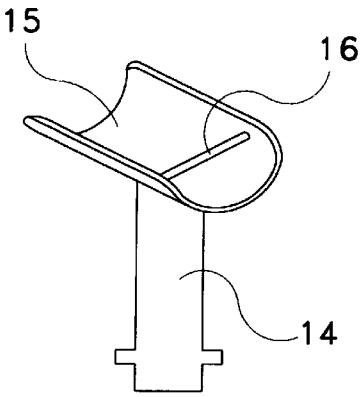
FIG. 9 is a view of the shuttle riser assembly.

As shown in FIG. 5, the head rest 4 can be adjusted with respect to the back 2. The head rest has a bar 41 attached thereto by any conventional means, and the chair back has a plate 51 with an aperture that receives the bar 41. A set screw 42 can be used to secure the bar in a selected position with respect to the back 42 of the chair.

Figure 15:
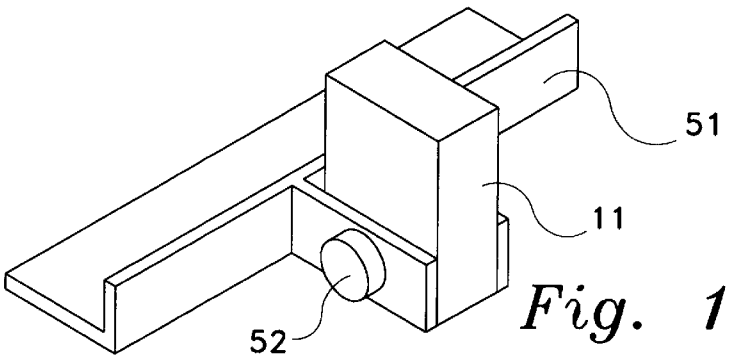
FIG. 15 is a partial view showing the means for locking the pedal assembly in position.
Figure 11:
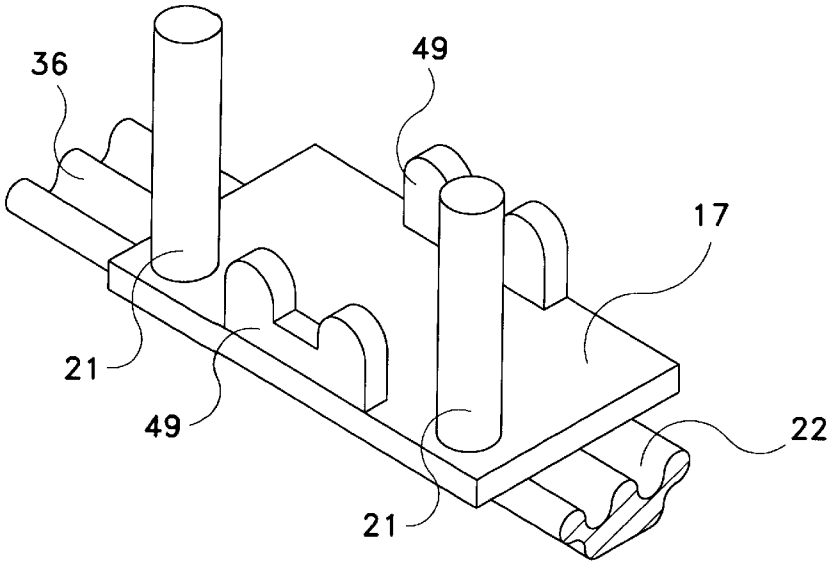
FIG. 11 is a partial view showing one of the shuttle assemblies.

As shown in FIGS. 1 and 6–8, bicycle type pedals 12 are mounted to the exercise device. The pedals 12 are mounted to a rotatable hub 13 similar to a bicycle's pedals. The pedals are mounted by means of a post 11 to support plate 38. The plate has rollers 39 which cooperate with V-shaped projections 40 on the tracks 22 to allow the pedal assembly to be positioned in front of the seat (which is the in use position) or to be slid along the tracks under the seat (which is the non-use or storage position). The pedal assembly can be locked in the stored position by a pin 52 which passes through aligned holes in the brace 51 and the support post 11 (see FIG. 15). A similar brace will be positioned to lock the pedal assembly in the use position. It should be noted that the brace is not shown in FIG. 1 for reasons of clarity.

In order to provide resistance to the movement of the pedals, a permanent magnet 60 is mounted on each side of the arms which connect the pedals 12 to the hub 13. In addition, metal plates 44 are secured to the hub so they will not rotate with respect to the hub. As the pedals, with the magnets, pass the metal plates, the magnets will be attracted to the plates which will require that the user push harder on the pedals to move them past the metal plates. This will provide resistance to the pedals. Obviously, the strength and position of the magnets 39 relative to the metal plate 44 can be varied in order to provide different resistance to the pedals 12.

Figure 16:
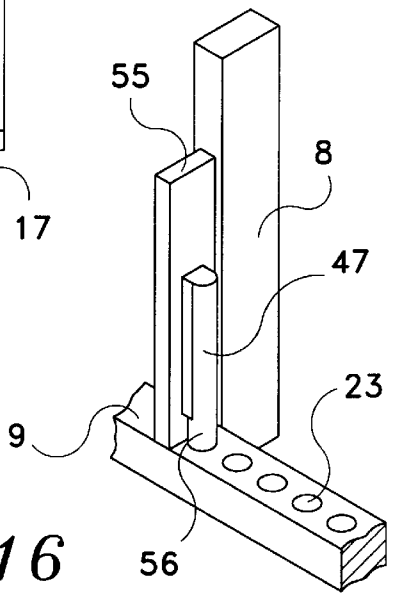
FIG. 16 is a partial view showing one of the locking mechanisms for the chair.

The chair can be moved along the tracks 22 so that it can be adjusted to fit users of different sizes, or to move the chair toward or away from the front piece 46 to perform different exercises. As shown in FIGS. 1 and 16, the legs 8 have a plate 55 attached thereto, and the plate has a strap 57 which receives a sliding bolt 47. Once the chair is placed in a selected position, it can be locked into that position by sliding the bolt 47 into one of the holes 23 placed along the top of side pieces 9.

Figure 10:
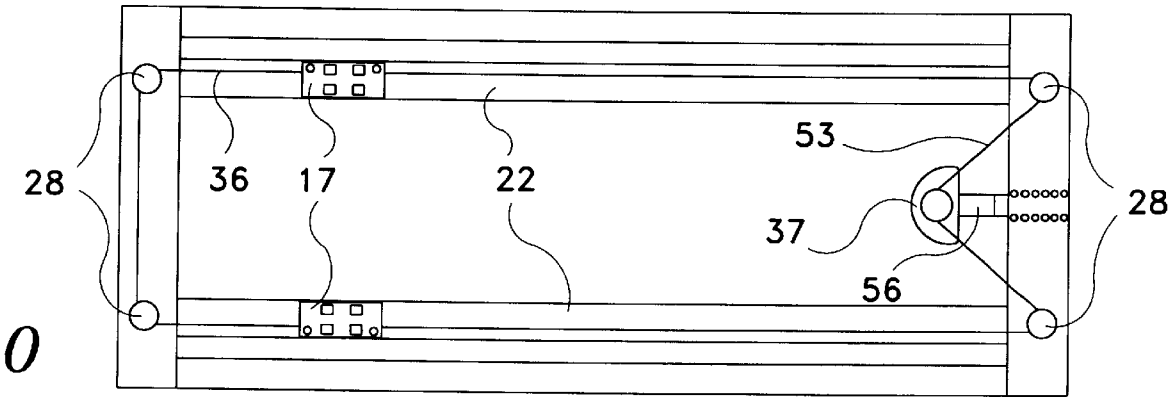
FIG. 10 is a partial view showing the cable assembly.
Figure 12:
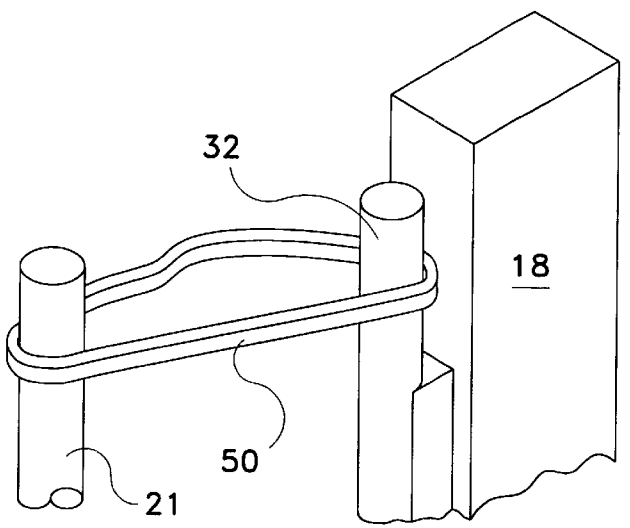
FIG. 12 is a partial view showing one of the tension band attachment bars.

Near the rear of this device is a flange 54 which has a hollow stem 56. Inside the hollow stem 56 is a spring 20. There is a hole 45 centered in the track side of end piece 10. Opposite this hole 45 is a fixed rod 25 that protrudes inward through the center of hole 45. The inside diameter of the spring 20 and the outside diameter of rod 25 are such as to allow spring 20 to slip over rod 25. The spring 20 protrudes out past the end of the hollow tube 56. Spring 20 is placed over fixed rod 25, then hollow stem 56 is pushed into hole 45 until spring 20 abuts against the inside wall of end piece 10 opposite hole 45. A cable 36 (see FIG. 10) is passed around the pulleys 37, 28 and the ends of the cable 36 attach the shuttles together so that as one shuttle 17, 21, 49 moves forward, the other shuttle moves rearward. The spring 55 provides an automatic tension adjustment for the cables.

In order to use the exercise device, a user would adjust the chair 2, 3, 4 so the back rest 2 and the head rest 4 are at the proper position for the individual user. Next the entire chair would be moved along tracks 22 until it is in the proper position and then locked in place by placing the bolts 47 into the holes 23 spaced along the side pieces 9. Next elastic bands 50 could be attached to posts 21 on the shuttles 17, 21, 49 and bars 32 and on the vertical posts 18 (or on bars 32) and/or to posts 21 on the shuttle 17, 21, 49 and bar 33 on the front chair legs to provide resistance. The user could then sit in the chair and place their legs into the concave portions 15 of the risers 14. At this point, the user can rest their heel with the bottom portion of their foot against the bar 16 (or by pulling on bar 16) with their heels, the user can exercise against the resistance of the bands 50.

An alternative exercise can be performed by removing the risers 14 and the user can then step onto the top of the shuttle 17, 21, 49 and use the device as a skier. Also while sitting in the chair in adjusted locked position, and with feet on the shuttles 17, 21, 49 resistance can be applied pushing, pulling or in both directions. The shuttles will be pulled in opposite directions by the cables as explained above.

An alternative exercise can be the stationary bike which can be used by positioning the pedals 12 in front of the chair 2, 3, 4 as described above, and pedaling as they normally would on a stationary bike.

Another exercise that could be performed is the stair climb, which can be performed by placing the step 24 in the proper holes 27 to attain the selected height. Then the user can alternately step up and down on the step 24.

Another exercise that could be performed is the isometric leg press, which is done by sitting or lying in the chair and pushing against the plates 30, 31.

The above exercises are merely examples of the types of exercises that can be performed with the device of the present invention. Other exercises can be designed to be used with the device of the present invention without departing from the scope of the invention.

Although the Knehab and the method of using the same according to the present invention has been described in the foregoing specification with considerable details, it is to be understood that modifications may be made to the invention which do not exceed the scope of the appended claims and modified forms of the present invention done by the others skilled in the art to which the invention pertains will be considered infringements of this invention when those modified forms fall within the scope of this invention.

What I claim as my invention is:

1. An exercise device comprising:

a frame having side pieces, tracks and end pieces connected together, a chair movably mounted on said tracks, a pair of shuttle members movably mounted on said tracks, a cable having opposite ends, each of which are attached to at least one of said pair of shuttle members, at least one pulley attached to one of said end pieces, and said cable passing around said at least one pulley, a plurality of bars attached to said frame, said chair and said shuttle members, and elastic resistance means attached to said bars for selectively providing resistance to movement of said chair and said shuttle members along said tracks, whereby a user may perform exercises by pushing and pulling against the resistance of said elastic resistance means.

2. The exercise device as claimed in claim 1, wherein one of said end pieces has a pair of vertical posts attached thereto, each of said vertical posts having a plurality of holes spaced along said vertical posts, and a step having a pair of rods attached thereto, said rods being insertable into selected ones of said holes to adjust the height of said step with respect to said vertical posts.

3. The exercise device as claimed in claim 2, wherein said vertical posts have at least one push plate secured thereto, said at least one push plate being mounted on said vertical posts between said vertical posts and said chair.

4. The exercise device as claimed in claim 3, wherein there are at least two push plates attached to said vertical posts, said at least two push plates being attached at an angle to each other.

5. The exercise device as claimed in claim 1, wherein each said shuttle has a post detachably secured thereto, each of said posts having a leg rest secured thereto, said leg rests having a concave shape, and a bar extending across said concave shape.

6. The exercise device as claimed in claim 5, wherein said leg rests are secured to said shuttles by means of a hollow element detachably mounted on said shuttle, and said hollow element has a notched flat bar attached to a lower end which can be slid into mounting blocks attached to said shuttle.

7. The exercise device as claimed in claim 1 , wherein said exercise device has a post, mounted in front of said chair, said post also having a pair of pedals rotatably mounted thereto, said post also having a pair of metal plates mounted on opposite sides, said pedals having magnets mounted thereon, whereby as said magnets pass said metal plates, the magnets will be attracted to said metal plates and thereby provide resistance to said pedals.

8. The exercise device as claimed in claim 1, further comprising a plurality of holes positioned along said side pieces, and said chair having bolts slidably attached thereto, said bolts being received in selected ones of said plurality of holes to secure said chair at selected positions along said side pieces.

9. The exercise device as claimed in claim 1, wherein said chair has a seat portion, a back rest and a head rest, said back rest being adjustably positioned with respect to said seat portion, and said head rest being adjustably positioned with respect to said back rest.

10. The exercise device as claimed in claim 1, wherein said at least one pulley attached to one of said end pieces is mounted on a flange, said flange having a hollow portion, and a spring mounted within said hollow portion.

11. The exercise device as claimed in claim 1, wherein said pair of shuttle members are movably mounted on said tracks by means of a plurality of rollers secured to said shuttle members, said rollers engaging said tracks.

12. The exercise device as claimed in claim 11, wherein said rollers have a concave portion, and said tracks have a V-shaped projection which engages said concave portion on said rollers.

* * * * *